United States Patent [19]

Koltz

[11] 4,058,207

[45] Nov. 15, 1977

[54] CONTAINER

[75] Inventor: Irving Morton Koltz, Scarborough, Canada

[73] Assignee: International Inpak, Inc., Saddle Brook, N.J.

[21] Appl. No.: 554,241

[22] Filed: Apr. 2, 1975

Related U.S. Application Data

[63] Continuation of Ser. No. 272,112, July 7, 1972, abandoned, which is a continuation-in-part of Ser. No. 160,806, July 8, 1971, abandoned.

[51] Int. Cl.[2] ..... B65D 25/54

[52] U.S. Cl. ..... 206/45.34; 206/806

[58] Field of Search ..... 206/45.31, 45.34, 44.12, 206/45.12, 461, 491, 806; 229/16 D, 31 R, 31 FS, 38, 52 B

[56] References Cited

U.S. PATENT DOCUMENTS

| | | | |
|---|---|---|---|
| 2,421,748 | 6/1947 | Fink | 224/31 R X |
| 3,072,247 | 1/1963 | Fielding | 229/16 D X |
| 3,121,493 | 2/1964 | Snape | 206/461 |
| 3,273,702 | 9/1966 | Palmer | 206/45.31 |
| 3,474,949 | 10/1969 | Shine | 229/52 B |
| 3,608,705 | 9/1971 | Moshel | 206/45.31 |
| 3,648,833 | 3/1972 | Dash | 206/45.31 |
| 3,746,242 | 7/1973 | Troth | 206/45.34 |

*Primary Examiner*—Steven E. Lipman
*Attorney, Agent, or Firm*—Sheldon H. Parker

[57] ABSTRACT

A package or container for articles of merchandise of generally rectangular shape, having four sides and two ends, in which one or more of the sides are formed of any transparent material extending across the full width and length of the box or container, thereby rendering the entire contents of the container visible, the remainder of the container being formed of any suitable material such as conventional cardboard materials or the like, or board, paper, plastic, foil, or even wholly of transparent materials.

In addition a package is disclosed having novel end closure means which is characterized by an absence of any inturned closure flap thereby leaving the interior of the package free of any obstruction, and also having endwise extensions exteriorly of the package.

In addition a package is disclosed having one or more sides cut away, without any transparent covering material, and end cuffs at each end for retaining the product in position, and employing the novel end closure means, and endwise extensions, to support and close the end cuffs.

2 Claims, 20 Drawing Figures

CONTAINER

This is a continuation, of application Ser. No. 272,112, filed July 7, 1972, now abandoned, which is a continuation-in-part of Ser. No. 160,806, filed July 8, 1971, now also abandoned.

The present invention relates to containers such as boxes, cartons or packages usually but not exclusively formed of cardboard, paper, plastic, foil, or the like material, preferably with a window adapted to be filled, closed, opened and displayed in various ways.

BACKGROUND OF THE INVENTION

Modern marketing techniques require that products and articles of merchandise be packaged in boxes or containers which themselves create a point of purchase display in a retail store or other outlet. Boxes, containers or the like which conceal their contents are undesirable since, in order to display the merchandise for sale, one or more such boxes must be opened, and the remainder stored elsewhere. Thus, for many years it has been the practice to provide cardboard or paper boxes or packages for a wide variety of merchandise, in which a portion of one side of the container is cut out, and covered with a thin sheet of transparent material such as acetate or the like to provide a so-called "window". Typical window packages of this kind are only partially successful. Since the window is cut out from only one side of the carton or container, the merchandise remains to a large extent completely hidden. In addition, such windows cannot be provided extending the full width or length of the container since the vast majority of containers are closed at each end by conventional tuck-in flaps. In some cases, it has been proposed to provide such a window extending around two sides of the container, but even in this case, the window does not extend the full length of the container, and as a result, the ends of the product or merchandise within the container still remain concealed. Typical examples of such window packages are shown in U.S. Pat. Nos. 1,761,249; 2,409,736; 3,186,622; 3,273,702; 3,351,188; 3,380,575; 3,448,853.

In order to overcome the shortcomings of the various types of conventional window package, an entirely different technique for packaging was developed known as "blister" packaging. In this technique, a sheet of transparent thermoformable material is formed, usually by vacuum forming techniques around the article of merchandise, with the periphery of the plastic sheet adhesively bonded to a backing card. This type of packaging has proved very popular, and has been successfully employed in the retailing of a very wide variety of merchandise. The principal advantage, of course, is the fact that the merchandise remains in full view at all times, constituting its own point of purchase display. The retailer does not have to remove the contents of the package to display it or show it, and any advertising material which may be desired can be printed on the backing sheet, such that the article itself is fully exposed to view, along with advertising material and directions. However, blister packaging has been found to be a costly procedure since the manufacturer of the merchandise must normally ship the merchandise, unpackaged, and therefore, unprotected, to a blister packager who then packages the merchandise one by one in his own plant in the manner described above. This involves substantial unnecessary expense and is time-consuming, and leads to delays between the manufacture of the merchandise and its delivery to the retailer. In most cases, blister packaging adds very substantially to the retail cost of the article and, in many cases, blister packaging is simply too expensive to be suitable for the packaging of various kinds of merchandise. As a result, many types of merchandise in which the retailing mark up is restricted, have been packaged in unsuitable containers or window packages which conceal the merchandise from view, which has, in turn, tended to somewhat increase the retailing costs of such articles and simultaneously decrease their appeal. Conversely, articles where a higher retailing mark-up could be obtained, have been packaged by blister packaging techniques where unnecessarily high packaging costs were incurred which substantially reduced the manufacturer's profit, and such increased costs have inevitably been passed on to the consumer who in the end is forced to pay a higher price for the article than is necessary.

Another factor which is of great importance in the selection of the most suitable package for an article of merchandise is the nestability or stacking qualities of the package. In many cases, point of purchase displays are made up by stacking the packages or containers one above the other. Conventional containers of cardboard or window packages formed principally of cardboard were readily adapted to nesting and stacking in this way, and in fact, provided for economical bulk shipping of such articles, and at the same time provided a simple, yet attractive, counter display in the retail outlet. On the other hand, blister packages being by their very nature of random contour and shaping, dependent upon the article contained therein and the vacuum forming process employed, were generally speaking, not nestable, and not stackable one above the other. As a result, such blister packages are normally required to be supported on some form of specially manufactured counter display such as a support column or a system of wire hangers or the like arranged on a peg board. In either case, the retailer is obliged to invest in point of purchase display supports for such blister packages which still further increases his retailing costs.

A still further factor of importance in the selection of the most suitable package is that fact that in many cases, the customer will wish to check the actual article of merchandise he is purchasing to make sure that there are no defects. This of course, involved removing the article from its container or package. In the case of a conventional cardboard container this presents no problem. One end flap is simply withdrawn from the package, and the article can be removed and inspected and then replaced and the end flap closed. On the other hand, in the case of a blister package, the only way in which the article can be removed from the package is by actually destroying the package. Once the package is destroyed, and if the customer should finally decide not to purchase the article, then of course, the article cannot readily be repackaged by the retailer, and it must be either thrown away or sold at a reduced price. For example, in the case of the sale of a toothbrush, the customer may wish to check the bristles to select a toothbrush of the appropriate type. If he should test one, and then discard it in favour of another, then the discarded product must be sold at a reduced price. On the other hand, if the retailer should refuse to allow the customer to check the product, then the customer may very well refuse to buy it.

BRIEF SUMMARY OF THE INVENTION

One form of the present invention, therefore, seeks to provide a package or container for articles of merchandise, of generally rectangular shape, having four sides and two ends, in which one or more sides are formed of any transparent such material extending across the full width and length of the box or container, thereby rendering the entire contents of the container visible, the remainder of the container being formed of conventional cardboard materials or the like, or board, paper, or even wholly of such transparent materials.

More particularly, it is an objective of the present invention to provide a carton or box having the foregoing advantages in which the two ends of the box are formed with endwise extensions extending outwards to either side of the box, to which the transparent material can be glued, or it may even be formed integrally therewith.

More particularly, it is an objective of the present invention to provide a carton or box having the foregoing advantages in which up to four complete sides of the box are formed of transparent material extending the full length of the container from one end to the other, the transparent material extending around two adjacent sides to render the entire contents of the container visible.

More particularly, it is an objective of the present invention to provide a box or carton having the foregoing advantages which may be manufactured and shipped flat to the manufacturer of the merchandise to be packaged therein, thereby occupying a minimum of space, and at the packaging zone on the production line, the cartons may be then set up, filled and closed in a relatively simple inexpensive operation.

More particularly, it is an objective of the present invention to provide a box or carton having the foregoing advantages which is provided with end closure means which may be opened and closed without actually destroying the box, if desirable, but which are, to all intents and purposes tamperproof and can only be opened with considerable difficulty.

More particularly, it is an objective of the present invention to provide a box or carton having the foregoing advantages which may be manufactured together with a hang tag or display card formed integrally therewith out of a single blank of material.

It is a further and related objective of the invention to provide a box or container of the type described, in which the entire container is formed of transparent material, with or without a card insert incorporated in a portion thereof and printed or otherwise decorated.

It is a further and related objective of the invention to provide a box or container having a window which extends almost the full width of the box, and without any transparent material covering such window, the merchandise being retained in the box by cuff-like portions or bands formed of the container material.

It is a further and related objective of the invention to provide a box or container of the type described which is completely closed in without any window at all, incorporating a novel end closure means.

The foregoing and other related advantages will become apparent from the following description of a preferred embodiment of the invention which is given here by way of example only with reference to the following drawings in which like reference devices refer to like parts thereof throughout the various views and diagrams.

BRIEF DESCRIPTION OF DRAWINGS

FIG. 17 is a perspective illustration of a box without any window at all, being completely closed in;

DETAILED DESCRIPTION OF THE PREFERRED EMBODIMENTS

Figure 1:
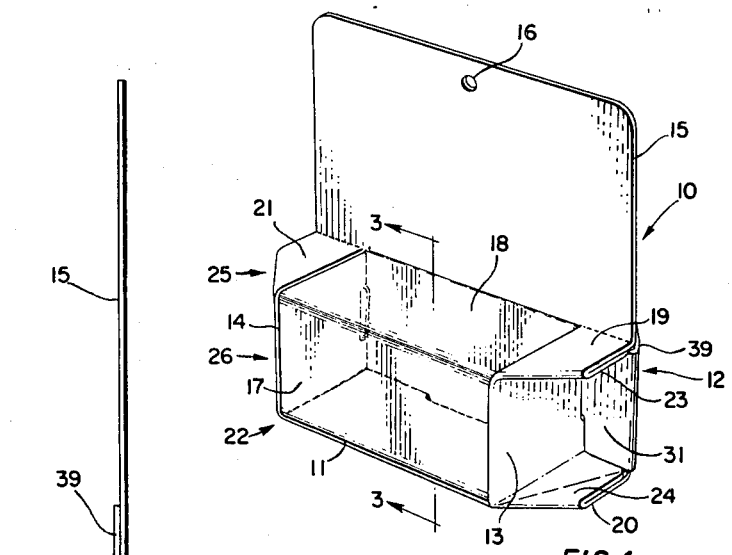
FIG. 1 is an upper perspective illustration of a carton according to the invention.
Figure 2:
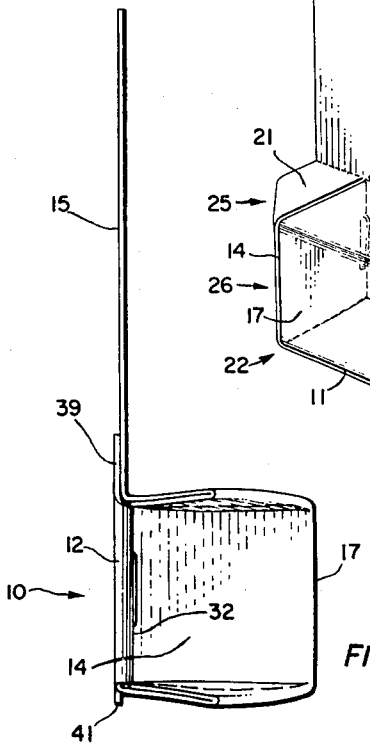
FIG. 2 is an end elevational view of the carton shown in FIG. 1.

Referring now to FIGS. 1 through 7, it will be seen that this preferred embodiment of the invention comprises a box or carton indicated generally by the reference 10. The carton 10 will be seen to comprise a lower side wall 11, a rear side wall 12, and end walls 13 and 14. A hang tag or display card 15 extends upwardly from the carton 10 for display purposes, and may be provided with a hole 16 by which the same may be hung from a wire rack or peg board or the like.

Figure 4:
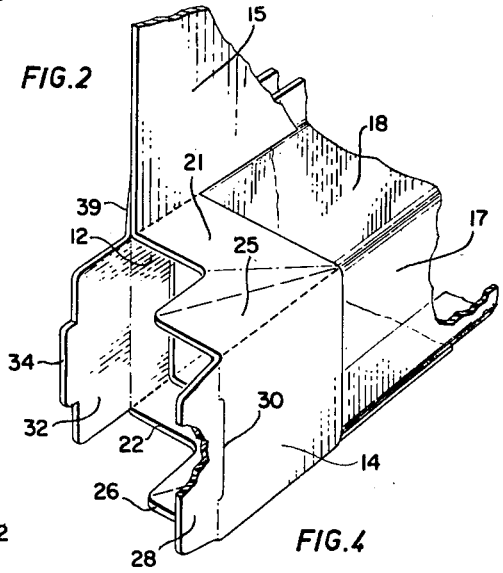
FIG. 4 is a partial perspective view of one end of the box shown in FIG. 1, shown open prior to insertion of an article therein.

The carton 10 will be further seen to comprise a front side wall 17, and a top side wall 18 made of a continuous sheet of transparent material such as acetate plastic, vinyl or the like, and extends the full width or length of the carton, that is to say from end wall 13 to end wall 14, and extends the full width of the sides 17 and 18, thereby rendering the entire interior of the carton 10 visible. The end panels 13 and 14 of the carton 10 will be seen to be joined integrally with the flange portions 19, 20 and 21, 22 respectively which extend endwise relative to the carton 10, in substantially the same plane as the top side 18 and the lower side 11. An intermediate gusset panel extends between each side of end panels 13 and 14, and their respective flange panels 19, 20, 21 and 22, the gusset panels being referenced respectively as 23, 24, 25 and 26. The end panels 13 and 14, as best shown in FIG. 4, are provided with endwise closure flap means 27 and 28 respectively. Slotted openings respectively referenced at 29 and 30 are provided along the line of juncture between the respective end panels 13 and 14 and their respective flaps 27 and 28, the flaps 27 and 28 being designed to fold outwardly with respect to the interior of the carton 10, and lie against endwise extensions of the back panel 12 thereof. In order to close and fasten the end panels 13 and 14, locking flaps 31 and 32 are provided as integral endwise extensions of the rear side 12 of the carton 10, and they in turn are provided with locking tabs 33 and 34 dimensioned and arranged to enter the slotted openings 29 and 30 respectively.

Figure 5:
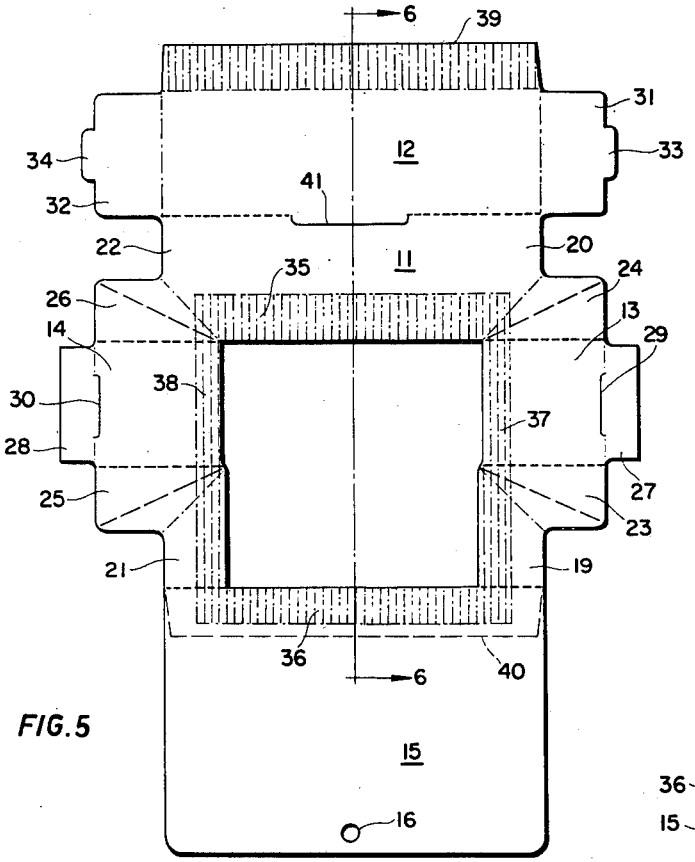
FIG. 5 is a plan view of a blank of cardboard or the like material at a stage in the manufacture of the box shown in FIG. 1.
Figure 6:
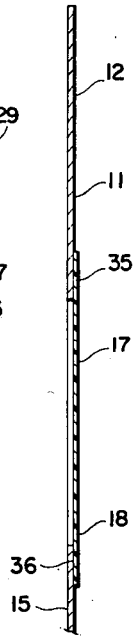
FIG. 6 is a sectional end elevational view along the line 6—6 of FIG. 5.

With particular reference to FIG. 5, it will be noted that the front and upper side walls 17 and 18 formed of plastic material are in fact formed of a single integral sheet of plastic shaped and dimensioned to overlap marginal portions of lower side wall 11, as at the glue area referenced as 35, and that it overlaps the display panel as at the glue area 36. In addition, the plastic forming front and side walls 17 and 18 overlaps the end panels 13 and 14, the gussets 23 and 25, and the flange portions 19 and 21, as at the glue areas 37 and 38.

It will have been noted that the flange portions 19, 20, 21 and 22, and their corresponding gusset panels 23, 24, 25 and 26, when folded in forms the shape of an irregular quadrilateral. This is caused by the cutting out of a generally rectangular portion lying between each flange and its associated gusset panel, as shown best in FIG. 4, with reference to the flange 21 and its associated gusset panel 25. It would of course be understood that in some cases, it is permissible to cut away more or less of the flange 21 and the associated gusset panel 25, and that if none is cut away at all, then when folded together they will adopt a more or less triangular shape. Obviously, in this latter case, the over all width of the package or container 10 will be substantially greater, but this may produce a package having a better appearance, or slightly greater strength in some cases as will be described below.

Figure 3:
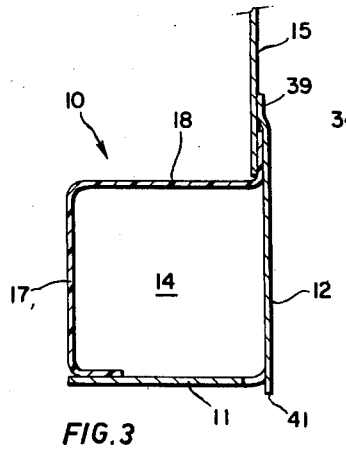
FIG. 3 is a sectional end elevational view along the line 3—3 of FIG. 1.

In addition, in order to hold the whole package together, a glue flap panel 39 is attached to the free edge of rear panel 12, and is adapted to overlap a portion or all of the rear surface of the display panel 13 as at the glue area 40. The glue area 40, in fact, overlaps the glue area 36 between the edge of the plastic upper wall 18, and the display panel 13, and as best shown in FIG. 3, forms a sandwich therewith.

In operation, the package is, of course, manufactured by cutting out the blank as shown in FIG. 5, and then gluing the transparent material forming the front and upper walls 17 and 18 in position over the gluing areas 35, 36, 37 and 38. The glue flap 39 is then glued in place over the glue area 40, and the package is then shipped flat to the manufacturer's or packagers plant.

Figure 7:
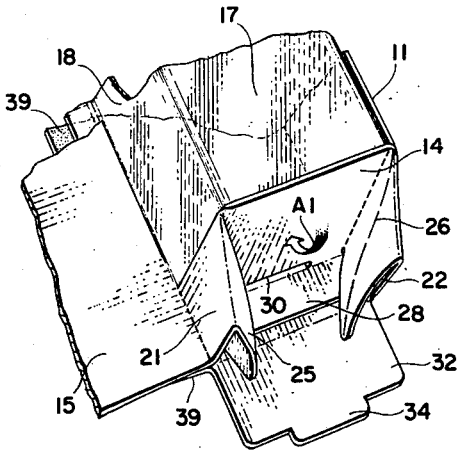
FIG. 7 is a partial perspective illustration of one end of the carton of FIG. 1 shown in a semi-closed position.
Figure 9:
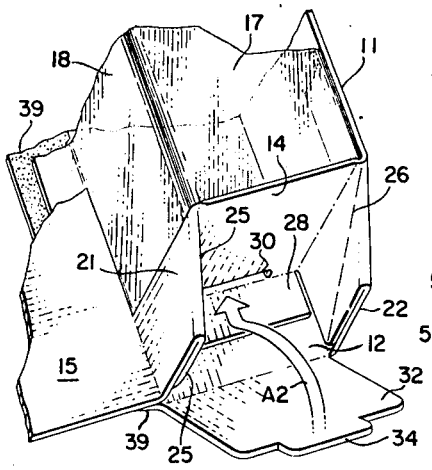
FIG. 9 is a partial perspective illustration of an end of the carton as shown in FIG. 1, in a further semi-closed position.

At point of packaging, by either hand labour or any suitable machine for the purpose (not shown), the package may be "set up" i.e. opened up so that the side walls 11, 12, 17 and 18 form a hollow square-shaped tube. Depending upon the design of the machinery at the point of packaging, the item of merchandise can then be inserted into the hollow square-shaped tube, afterwhich both ends would then be closed simultaneously. Alternatively, one end can then be closed, the article of merchandise inserted, and then the other end closed. It will be appreciated that the two ends of the container 10 are mirror images of one another and accordingly, the process of closure at each end is the same. Thus, in order to close one said end, the end flap 14 is folded inwardly towards the back panel 12, with the gusset portions 25 and 26 and the flange portions 21 and 22 flexing outwardly to permit such closure. The end panel 14 is preferably pushed inwardly in the direction of the arrow A, of FIG. 7 until it is standing more or les at right angles to the back panel 12, with its closure flap 28 lying flat against the endwise portion of back wall 12 as shown in FIG. 7. The gusset portions 25 and 26 are then pressed tight against the flange portions 21 and 22 as shown in FIG. 9, and the locking flap 32 is then folded inwardly into the space between the flange member 21 and 22 along the line of the arrow A2 of FIG. 9. The flap 32 is pressed flat against the underlying portion of the back wall 12, and the closure flap 28, and the tab 34 2ill then flap into place in the slotted opening 30. This will securely hold the end wall 14 in position against any unauthorized opening of the package.

If it has not already been filled, the package or container 10 may then be filled from the opposite end, and that end may then be closed in exactly the same manner as described above. The package may then be shipped out.

It is particularly noteworthy, that since the package is provided with symmetrical sides 11, 12, 17 and 18, that it can be very readily nest in a large packaging case by simply laying two such containers 10 face to face with the display panel 15 of one overlying the front panel 17 of the other.

If desired, in order to ensure that the package or container 10 stands upright on a flat surface, a foot or leg 41 may be struck out of the lower side 11, so as to tilt the package 10 slightly forwardly, thereby overcoming any tendency for the panel 15 to cause it to overbalance rearwardly.

The invention is, of course, capable of many different modifications for different specific applications.

Figure 8:
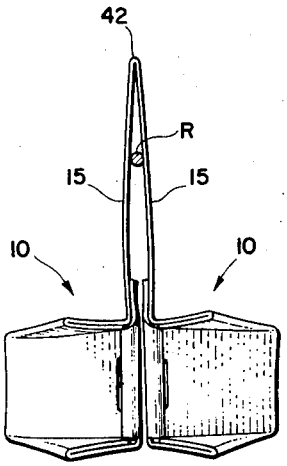
FIG. 8 is an end elevational illustration of a further embodiment of the carton of FIG. 1, in which two such cartons as shown in FIG. 1 are formed in pairs.

For example, FIG. 8 shows a further alternative embodiment, in which two packages or containers 10 are formed out of a single blank of material, by simply cutting out a blank similar to that shown in FIG. 5 and cutting out a mirror image of that blank as an endwise extension of the display panel 15, and then simply folding it along a median line indicated as 42 so that two containers 10 are provided back to back. They then can of course be supported by simply hanging them over a rail or the like.

Figure 10:
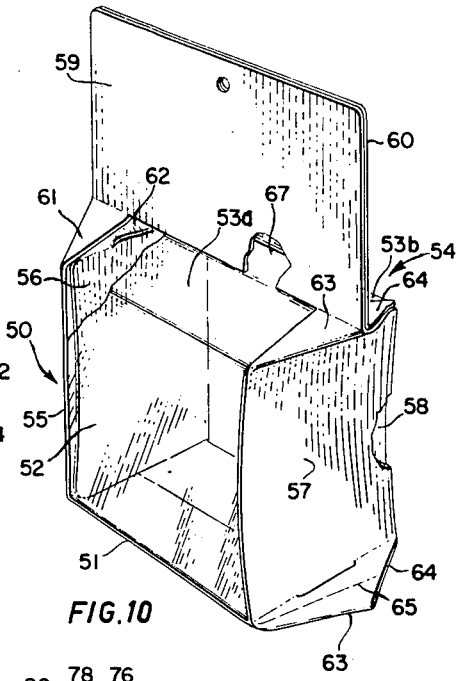
FIG. 10 is an illustration of a further embodiment of the invention.

Another alternative embodiment is shown in FIG. 10. In this embodiment, a container referenced as 50 is provided with a lower side wall 51 formed of cardboard or the like and three transparent side walls, namely the front side wall 52, the upper side wall comprising front and rear upper panels **53*a* and 53*b* and the rear side wall 54 are all formed out of transparent plastic material such as acetate or the like thereby providing an even better opportunity for inspection of the contents of the package 50 than in the case of the container 10**.

In this embodiment, the cardboard portion of the package 50 comprises the lower side panel 51 and the overlapping end panels 55, 56 and 57, 58. The header flaps 59 and 60 are also formed of cardboard material integrally with the end flaps 55, 56, 57 and 58, and extend upwardly along a median line of the container 50. The end flaps 55, 56 respectively are formed integrally with respective upper and lower flange portions 61 and 62, only the upper flange portions being shown in FIG. 10, and the end flaps 57, and 58 are likewise provided with upper and lower flange portions 63 and 64.

Between the end flap 57 and its upper and lower flange portions 63, infolding gusset portions 65 are provided, and likewise between the end flap 58 and its associated upper and lower flange portions 64, infolding gusset portions 66 are provided. At the opposite end of the container 50, similar gusset portions (not shown) are provided between the end flaps 55 and 56 and their respective upper and lower flange portions 61 and 62.

As shown in FIG. 10, the transparent panels 52 and 54, and the front and rear upper panels 53*a* and 53*b*, may be composed of two separate pieces of plastic, having a marginal portion 67 sandwiched between the front and rear header flaps 59 and 60 as shown in FIG. 10.

Figure 11:
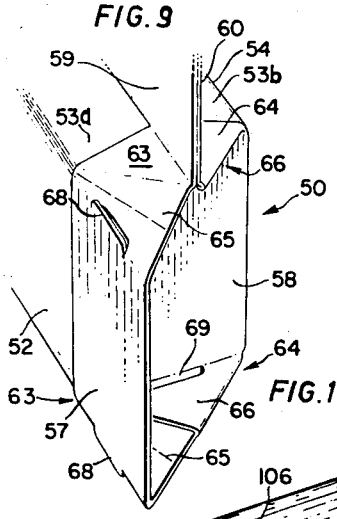
FIG. 11 is an enlarged perspective of one end of the embodiment of FIG. 10.

Locking of the two ends of the container 50 is effected by locking tabs 68, provided on the flanges 57 and 55, fitting within the struck out openings 69, only one such opening being shown in FIG. 11 for the sake of clarity.

Figure 12:
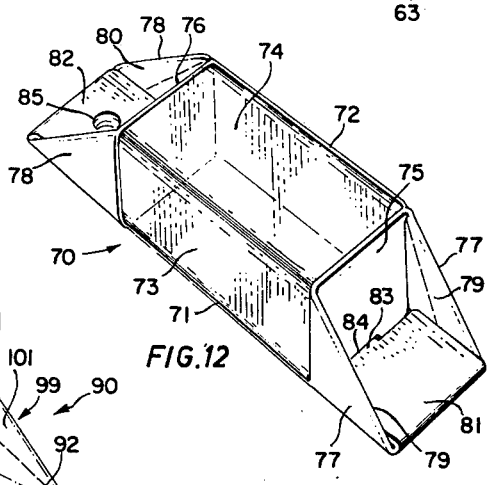
FIG. 12 is a further embodiment of the invention.

For other applications, where no header flaps are required, for example in the case of packaging a long thin article which may be allowed to lie on a counter or the like, a further modification of the invention may be employed as best shown in FIG. 12. In FIG. 12, container generally referenced as 70 is shown having a lower side wall 71 and a rear side wall 72 formed of cardboard or the like opaque material, and a front panel 73 and a top panel 74 formed of transparent material. End closure flaps 75 and 76 are provided, in the same way as in the embodiment of FIG. 1, formed integrally with end flange portions 77 and 78. Infolding gusset portions 79 and 80 extend between respective end flaps 75 and their flanges 77 and end flaps 76 and their flanges 78. Each of the end flaps 75 and 76 is closed by a closure flap 81 and 82 respectively, provided with locking tabs 83 locking in a slotted opening 84, only one such tab 83 in opening 84 being shown for the sake of clarity. A opening 85 is provided at one end for supporting the same on a hook or rail if desired. It is noteworthy that in the embodiment of FIG. 12, the end flanges 77 and 78 are of essentially triangular shape, unlike the end flanges of the embodiment of FIG. 1 which are essentially quadrilateral in shape. In this embodiment, as shown in FIG. 12, where the package or container 70 is somewhat more elongated, and has a smaller cross-section, the greater length of the triangular shaped end flanges is found both to enhance the appearance of the container or package 70, and also to provide slightly greater strength.

Figure 13:
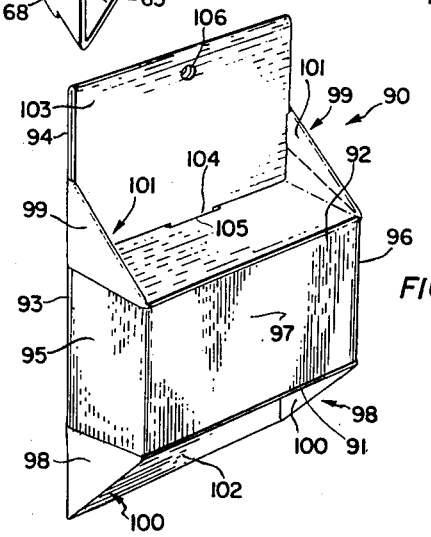
FIG. 13 is a further embodiment of the invention.

In some cases, it may be desirable to make a container according to the invention in which the width of the container is essentially no greater than the width of the article to be supported therein, and in such event, the arrangement of the end flanges of FIG. 1 can be altered and modified so that they extend upwardly and downwardly with reference to the interior of the container rather than out to either side. As shown therefore in FIG. 13, such a modified form of container is shown generally as 90, and having lower and upper end walls 91 and 92 formed of cardboard or the like opaque material, and a back wall 93, and a header panel 94, all being formed of cardboard or the like opaque material in this embodiment. Three sides of the container 90 in this embodiment are provided of transparent material, namely the left and right hand side panels 95 and 96 and the front panel 97, formed of a single sheet of transparent material such as transparent plastic or acetate or the like material wrapping around the two sides and the front of the container 90 as shown. End flange portions 98 are provided on either side of the lower end panel 91, and end flange portions 99 are provided on either side of the upper end panel 92. Respective infolded gusset portions are provided, namely gusset portions 100, adjacent the lower end flange portions 98, and upper gusset portions 101 provided adjacent the upper end flange portions 99. A lower end closure flap 102 is provided to interlock with the lower end panel 91, and is provided with any suitable locking tab means, (not shown). An upper end closure panel 103 is provided, being in fact a folded over portion of the header panel 94, and provided with a locking tab 104 adapted to interlock with the slotted opening 105 in the upper end panel 92 as shown. Any suitable opening such as 106 may be provided for supporting the same from a rail or peg if desired.

Figure 14:
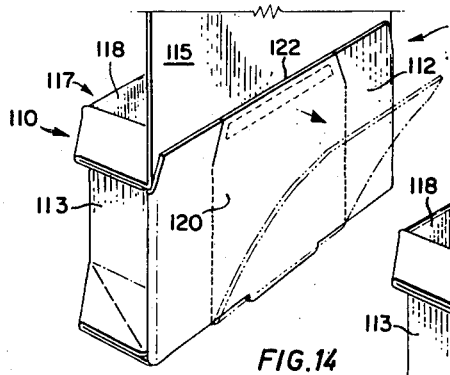
FIG. 14 is a perspective illustration of a further embodiment of the invention showing a container or box having a window, and a re-closeable flap.
Figure 15:
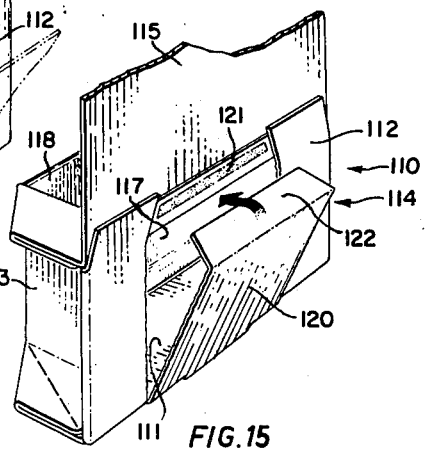
FIG. 15 is an enlarged perspective of a detail of FIG. 14.

In certain cases, it may be desirable to provide a package which the purchaser can rip open and then reclose, thereby extending the life of the package, without going through the necessity for folding the end panels in and out. Such a further embodiment of the invention is shown with reference to FIGS. 14 and 15. Essentially, in this embodiment, a container 110 is shown, essentially identical to that shown in FIG. 1, and having a lower side 111, a rear side 112, and end panels 113 and 114 (not shown) and front and upper transparent panels 117 and 118. Essentially, the only difference is in the construction of the back panel 112, which in this embodiment is provided with a perforated trap door panel 120 which is normally adhered to the back of the display panel 115, along a modified glue area 121. The glue in the area 121 is of a modified nature, and provides less holding power than the glue holding the remainder of panel 112 to the display panel 115, and enables the purchaser to grasp the upper portion 122 and tear it open, afterwhich the upper portion 122 can be folded downwardly, and may be slipped back into the interior of the box or container 110. Note that the portion 122 tapers inwardly at either side so that it may more readily enter into the opening left by the panel 120, in the rear wall 112 as shown in FIG. 15.

Figure 16:
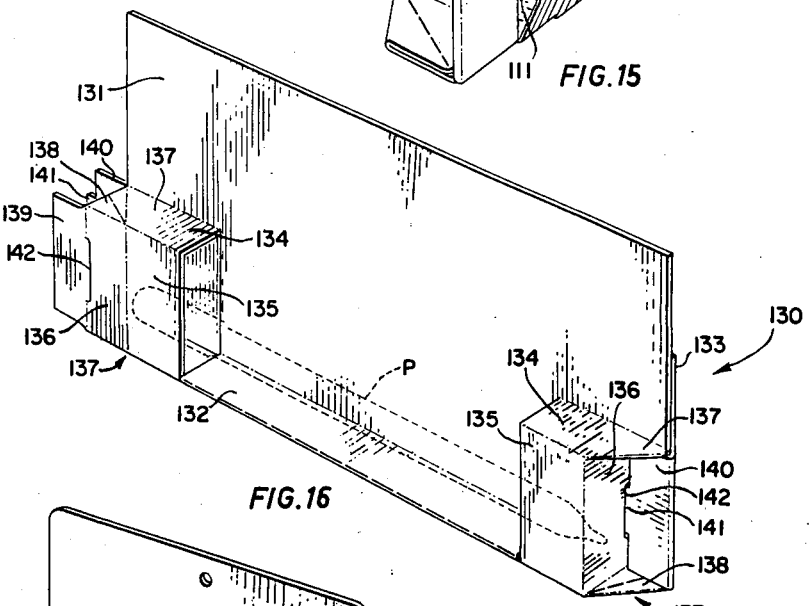
FIG. 16 is a perspective illustration of a further embodiment of the invention in which the window is left open.

In some cases, it may be desirable to employ the end closures of the invention in a package without any transparent material whatever, the articles themselves simply being gripped at either end, and otherwise being completely exposed. Such a modified form of package is shown in FIG. 16. The package referenced generally as 130 will be seen to consist of a one piece back panel and display panel referenced 131, a lower side panel 132, and a reverse back panel 133. Note that the lower side panel 132 is in fact formed simply by doubling over the end of the panel 131, and the reverse panel 133 is simply the end of such doubled over panel, glued to the back of the panel 131. At each end of the package 130, enclosure cuff portions are formed by struck out portions of the back panel 131. Such struck out portions comprise the upper wall 134, and the front side wall 135 which at its lower end joins with the folded over portion of the lower side panel 132 as shown. Preferably, the walls 134 and 135 form end enclosures, spaced apart a predetermined distance and adapted to enclose the ends of particles such as pens, pencils or the like indicated by the general reference arrow P, one such article being shown in phantom. In order to insert and remove such articles P, end closures are provided, essentially in accordance with the invention as shown in FIGS. 1 to 15. Such end closures comprises the end panels 136, provided with end flanges 137, and associated infolded gusset portions 138. Locking flaps 139 are provided as endwise extensions of each such end panel 136, and closure flaps 140 are provided having locking tabs 141 adapted to fit within slotted openings 142 as described above. Obviously, articles such as the pencils or pens P can be inserted and each of the ends of the article is then closed exactly as described in connection with the embodiment of FIG. 1, afterwhich such articles are effectively trapped, although exposed to view, and unprotected by any window material. Such articles cannot be removed without effectively either opening one or other end of the package 130, or tearing it apart.

Figure 17:
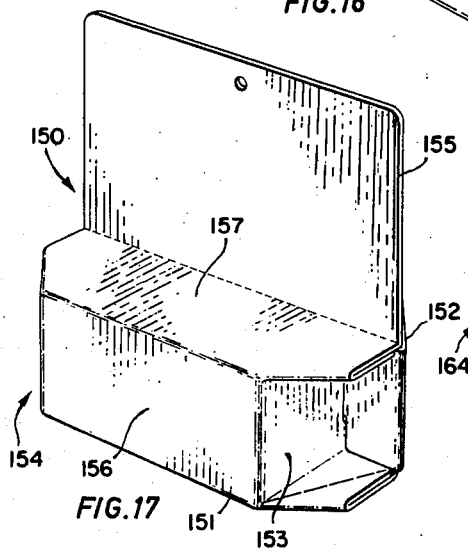

In some cases, it may be desirable to employ the closure means as shown in the embodiment of FIG. 1 in a package without any window opening at all, perhaps for the sake of economy or additional security or the like. Such a modified form of package is shown in FIG. 17 as reference 150. It will of course consist of a lower panel 151, a back panel 152, end panels 153 and 154, a display panel 155 and front and upper side panels 156 and 157, all formed of opaque cardboard material or the like without any window opening, whether or not covered with transparent mateials. The end closure means are provided exactly as shown in FIG. 1, and further description is deemed unnecesary.

Figure 18:
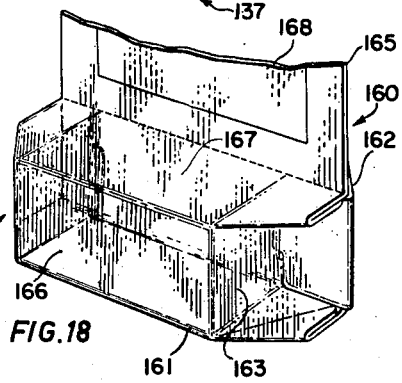
FIG. 18 is a perspective illustration of an alternate embodiment of FIG. 1.

In certain cases, it may be desirable to manufacture a package such as shown in FIG. 1 entirely out of transparent material, without any cardboard supporting material whatever. Such a modified form of package is shown in FIG. 18 and referenced 160. It will be seen to have a lower side panel 161, a rear side panel 162, end panels 163 and 164, a display panel 165, and front and upper side panels 166 and 167. All of these panels will be formed of a single blank of transparent material as shown, and the end closures will be formed essentially as described in connection with the embodiment of FIG. 1, further explanation being deemed to be unnecessary.

For display purposes only, a sheet of printed material or cardboard or the like referenced as 168 may be laminated together with the display panel 165, to provide for directions and point of purchase advertising material, although obviously, if desired the transparent material itself could be used as the printing surface for whatever descriptive material is required.

Figure 19:
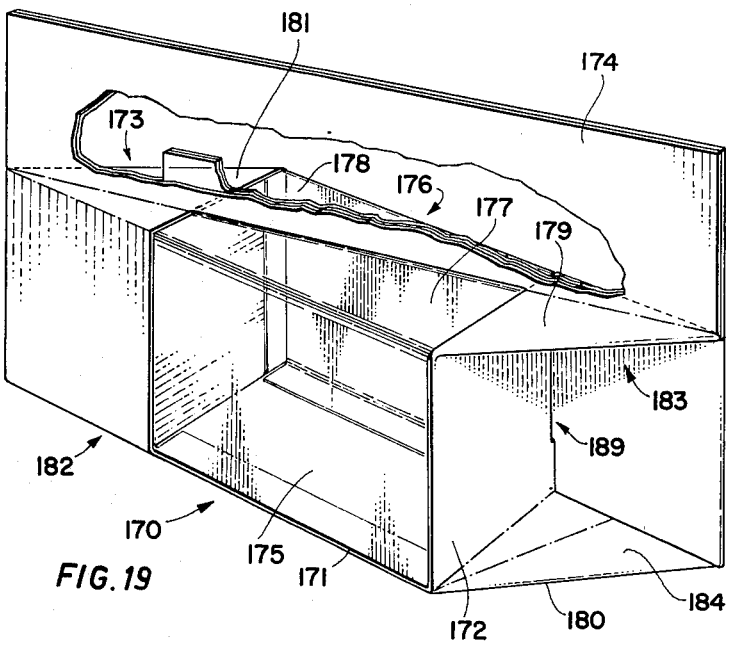
FIG. 19 is a perspective illustration of a further embodiment.
Figure 20:
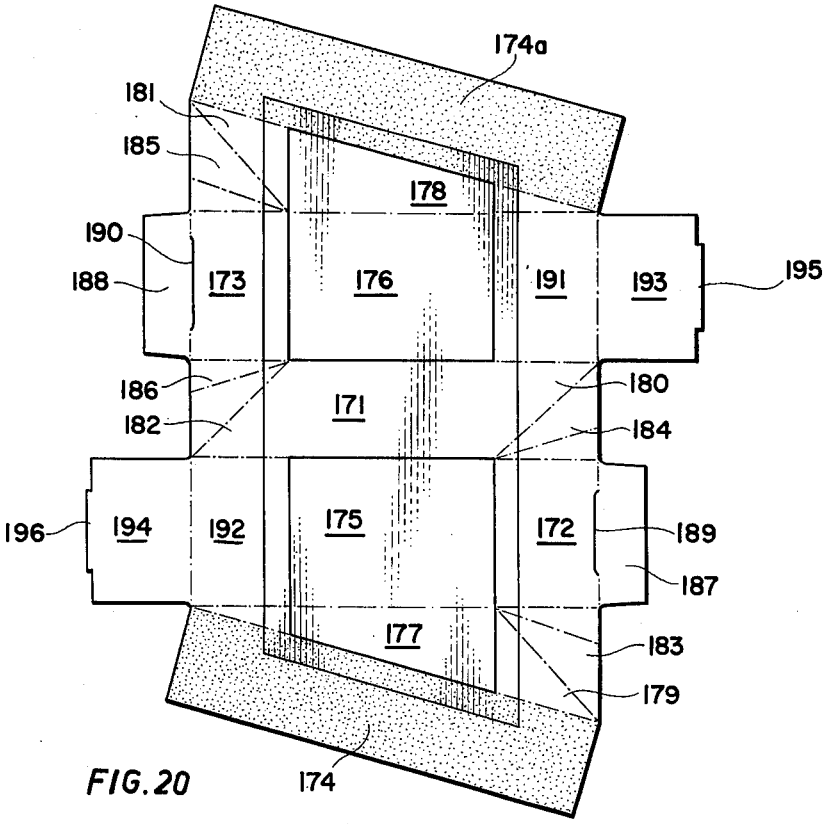
FIG. 20 is a plan view of a blank for the embodiment of FIG. 19.

A further embodiment of the invention is shown in FIGS. 19 and 20. It will be seen that this embodiment of the invention may be considered as a hybrid of FIGS. 1 and 10. In this embodiment, the package is shown generally as 170, and will be seen to comprise a lower side wall 171, and end walls 172 and 173. A hang tag or display card 174 extends upwardly from the container 170, and extends along the length thereof in a diagonal manner from one end to the other.

The container 170 will further be seen to comprise opposed vertical side walls 175 and 176, one of which may be considered as a front side wall and the other as a rear side wall.

However, it will of course be appreciated that this particular construction of package is in fact reversible that is to say either side can be regarded as the front. In addition, the container 170 comprises two generally elongated triangular top wall portions, 177 and 178. It will be seen that the front and rear side walls 175 and 176 and the top wall portions 177 and 178 are all made of transparent material such as acetate plastic, vinyl or the like, and all extend the full length of the container 170 whereby to render the contents thereof fully visible, and constitute a particularly attractive display package.

The end walls or panels 172 and 173 are formed essentially in much the same manner as the end walls or panels of the embodiment of FIG. 1, with the exception that one such end wall is reversed with respect to the other as shown in FIG. 19.

Thus the end wall 172 is integrally joined to flange portions 179, 180, and the end wall or panel 173 is integrally joined to flange portions 181 and 182. An intermediate gusset panel extends between each side of each of end panels 172 and 173, and their respective flange panels 179 and 180, and 181 and 182, the gusset panels being referenced respectively 183, 184, 185 and 186. In addition, the end panels or walls 173 and 174 are provided with end-wise closure flap means 177 and 178, which are themselves provided with slotted openings 189 and 190 along the line of juncture between the respective end panels or walls 173 and 174 and closure flaps 187 and 188.

In order to complete the ends of the container 10, there are provided the front and back side extensions 191 and 192 formed of card stock or other suitable material, which are themselves provided with integral hinged locking flaps 193 and 194. Locking flaps 193 and 194 are themselves provided with tongue members 195 and 196 adapted to interlock with the slotted openings 189 and 190.

As shown more particularly in FIG. 20, the various walls and panels may be made out of a single blank of cardboard or other suitable container forming material, with two quadrilateral shaped openings punched out therefrom to provided spaces for attachment of the front and back side walls 175 and 176 and top wall panels 177 and 178 as shown. In addition, if desired although this may not always be necessary, the transparent front and back side panels 175 and 176 and top panel portions 177 and 178 can themselves be formed out of a single portion of transparent material. As shown in FIG. 20, the hang tag or display panel 174 is in fact formed of two thicknesses of cardboard or other material, the rear thickness being shown as 174*a*. In this way, the same printing or descriptive material may be made to appear on both sides of the hang tag 174 thus resulting in a more attractive and versatile package.

The foregoing is a description of various preferred embodiments of the invention which are given here by way of example only. The invention is not to be taken as limited to any of the specific features as described, but comprehends all such variations thereof as come within the scope of the appended claims.

What I claim is:

1. A container for merchandise and comprising:

a generally rectangular container having four sides and two ends defining a generally rectangular interior, said sides having a predetermined length and breadth, and, transparent panel means forming at least one said side and extending the full lenght and breadth thereof, and further including transparent panel means forming three sides of said container namely a front side, a rear side, and an upper side, and display panel means formed integrally with said ends and extending along a median line of said transport upper side.

2. A container for merchandise and comprising:

a generally rectangular container having four sides and two ends defining a generally rectangular interior, said sides having a predetermined length and breadth, and, transparent panel means forming at least one said side and extending the full length and breadth thereof, and further including display panel means associated therewith, said display panel means extending from one side thereof, and lying in a plane which is offset with respect to the planes of the two adjacent sides, whereby to extend in substantially diagonal manner from one end to the other of said container.

* * * * *